US011986105B2

(12) United States Patent
Rumfola, III et al.

(10) Patent No.: US 11,986,105 B2
(45) Date of Patent: May 21, 2024

(54) INFANT POSITIONER WITH REPOSITIONABLE ENTERTAINMENT COMPONENT

(71) Applicant: Mattel, Inc., El Segundo, CA (US)

(72) Inventors: Ross Rumfola, III, Akron, NY (US); Nicholas Joseph Stachowski, Orchard Park, NY (US); Jairo Andres Hurtado, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 17/955,222

(22) Filed: Sep. 28, 2022

(65) Prior Publication Data

US 2024/0099481 A1 Mar. 28, 2024

(51) Int. Cl.

| | |
|---|---|
| ***A47D 13/04*** | (2006.01) |
| ***A47D 1/00*** | (2006.01) |
| ***A47D 13/08*** | (2006.01) |
| ***A47D 15/00*** | (2006.01) |

(52) U.S. Cl.

CPC ..... *A47D 13/08* (2013.01); *A47D 1/008* (2013.01); *A47D 15/00* (2013.01)

(58) Field of Classification Search

CPC ..... A47D 13/08; A47D 13/086; A47D 13/04; A47D 13/043

See application file for complete search history.

(56) References Cited

U.S. PATENT DOCUMENTS

| | | | | |
|---|---|---|---|---|
| 3,635,522 | A | 1/1972 | Kerwit | |
| 6,203,395 | B1 * | 3/2001 | McElhaney | A63H 33/006 446/175 |
| 6,332,824 | B2 | 12/2001 | Tell et al. | |
| 6,802,757 | B1 * | 10/2004 | Sejnowski | A63H 33/38 446/175 |
| 7,017,924 | B1 * | 3/2006 | Lambert | A47D 13/043 280/87.051 |
| 7,244,165 | B2 | 7/2007 | Gubitosi et al. | |
| 7,740,560 | B2 | 6/2010 | Tadin et al. | |
| 8,795,023 | B2 | 8/2014 | Elson | |
| 9,370,257 | B2 * | 6/2016 | Roberts | A47D 13/08 |
| 9,439,512 | B2 | 9/2016 | Miller et al. | |
| 10,456,701 | B2 | 10/2019 | Healy et al. | |
| D868,900 | S | 12/2019 | Healy et al. | |
| D921,763 | S | 6/2021 | Aslan et al. | |
| 11,426,008 | B2 * | 8/2022 | Sclare | A47D 1/10 |
| 2004/0262955 | A1 * | 12/2004 | Wu | A47D 13/04 297/148 |
| 2013/0244533 | A1 * | 9/2013 | Elson | A63H 33/006 446/227 |
| 2014/0265514 | A1 * | 9/2014 | Roberts | A47D 13/08 297/440.11 |

(Continued)

*Primary Examiner* — Robert G Santos
*Assistant Examiner* — Ifeolu A Adeboyejo
(74) *Attorney, Agent, or Firm* — Edell, Shapiro & Finnan, LLC

(57) ABSTRACT

An infant positioner and an entertainment component that is useable with the infant positioner in different positions. The entertainment component can be placed in at least a first position and a second position different from the first position. The entertainment component is coupled to a support structure of the infant positioner while the entertainment component is in the first position as well as in the second position.

17 Claims, 15 Drawing Sheets

(56) References Cited

U.S. PATENT DOCUMENTS

| | | | | |
|---|---|---|---|---|
| 2016/0058201 | A1* | 3/2016 | Pavkov | A47D 1/006<br>297/440.22 |
| 2017/0232355 | A1* | 8/2017 | Healy | A47D 3/001<br>446/227 |

* cited by examiner

INFANT POSITIONER WITH REPOSITIONABLE ENTERTAINMENT COMPONENT

TECHNICAL FIELD

The present disclosure is directed towards an infant positioner and an entertainment component that is useable with the infant positioner in different positions.

BACKGROUND OF THE INVENTION

Various types of infant positioners or support structures exist that include a mechanism that is intended to provide entertainment to an infant in or on the infant positioner or support structure. Conventional entertainment mechanisms are often located in one position on an infant positioner or support structure, which limits the amount of entertainment that the mechanism can provide to the infant.

Therefore, there is a need for an infant positioner that has an entertainment component that can be repositioned relative to the support structure of the infant positioner, and that can be coupled to the support structure while in different positions.

SUMMARY OF THE INVENTION

The present disclosure is directed to an infant positioner that includes a support structure comprising a seat support having a periphery; and a ground engaging portion engageable with a support surface, the ground engaging portion extending beyond the periphery of the seat support, the seat support being coupled to the ground engaging portion such that the support structure has a deployed configuration; a seat coupled to the seat support, the seat configured to support a child; and an entertainment component removably coupleable to the support structure, the entertainment component being disposable in a first position in which the entertainment component is mounted on the support structure, and in a second position in which the entertainment component is spaced apart from and coupled to the support structure, the entertainment component being proximate to the seat in the first position and proximate to the ground engaging portion in the second position.

In an alternative embodiments, the support structure includes a tray that is removably coupleable to the ground engaging portion. The tray has a mounting component that engages the entertainment component when the entertainment component is in its first position. The tray includes a housing with a cavity formed therein, and the cavity receives a portion of the entertainment component when the entertainment component is coupled to the tray. The mounting component is a tab that extends into the cavity, the entertainment component includes a slot formed therein, and the slot receives the tab when the entertainment component is mounted on the tray. The support structure includes at least one support arm and a tray, the at least one support arm movably couples the seat support to the ground engaging portion, and the tray is coupleable to the at least one support arm.

In another embodiment, the entertainment component includes a housing and a pivotally mounted support stand coupled to the housing, the support stand having a first end coupled to the housing and a second end opposite to the first end, the second end is proximate the housing when the entertainment component is in its first position mounted on the support structure, and the second end is spaced apart from the housing when the entertainment component is in its second position spaced apart from and coupled to the support structure.

In another embodiment, the ground engaging portion includes a base and at least one support arm coupled to the base, the at least one support arm is coupled to the seat support and positions the seat support away from the base, the at least one support arm includes a connector, the support structure includes a tray with a connector, the tray connector is engageable with the at least one support arm connector to mount the tray to the at least one support arm, and the tray includes a mounting component that engages the entertainment component when the entertainment component is in its first position.

In various embodiments, the ground engaging portion includes a base and at least one support arm coupled to the base, the at least one support arm is coupled to the seat support and positions the seat support spaced apart from the base, the base includes at least one coupler coupled thereto, and the coupler is engageable with the entertainment component when the entertainment component is in its second position. The coupler is a flexible strap with at least one tab, the entertainment component includes a housing with at least one slot formed therein, and the flexible strap is engageable with the at least one slot on the housing to couple the entertainment component to the support structure when the entertainment component is in its second position. The flexible strap includes a first tab and a second tab, the first tab on the flexible strap is usable to retain the entertainment component in its second position, the second tab on the flexible strap is usable to retain the entertainment component in a third position, and the entertainment component in its third position is further spaced apart from the ground engaging portion than when the entertainment component is in its second position.

In another embodiment, the entertainment component is placeable in a third position in which the entertainment component is spaced apart from and coupled to the support structure, the third position of the entertainment component is farther away from the support structure than the second position of the entertainment component, the support structure includes a coupler that is engageable with the entertainment component, and the support structure is engaged with the entertainment component when the entertainment component is in its second position and in its third position. The coupler is a flexible member with a first positioner and a second positioner coupled thereto, the first positioner engages the entertainment component when the entertainment component is in its second position, and the second positioner engages the entertainment component when the entertainment component is in its third position.

In an alternative embodiment, an infant positioner according to the present invention includes a support structure comprising a seat support having a periphery; a ground engaging portion engageable with a support surface, the ground engaging portion extending beyond the periphery of the seat support, the seat support being pivotally coupled to the ground engaging portion such that the support structure has a deployed configuration, the ground engaging portion having at least one flexible coupler mounted thereto; and a tray removably coupled to the ground engaging portion, the tray being proximate to the seat support; a seat coupled to the seat support, the seat configured to support a child; and an entertainment component removably coupleable to the support structure, the entertainment component being placeable in a first position in which the entertainment component is mounted to the tray, and in a second position in which the entertainment component is spaced apart from and coupled to the support structure via the at least one flexible coupler, the entertainment component being proximate to the seat in the first position and proximate to the ground engaging portion in the second position.

In another embodiment, the entertainment component is placeable in a third position in which the entertainment component is spaced apart from and coupled to the support structure via the at least one coupler, the entertainment component being proximate to the ground engaging portion in the third position, the third position being farther from the ground engaging portion than the second position. The at least one flexible coupler includes a first positioner and a second positioner, the at least one flexible coupler is engageable with the entertainment component, the first positioner engages the entertainment component when the entertainment component is in its second position, and the second positioner engages the entertainment component when the entertainment component is in its third position. The entertainment component includes a housing that has a slot formed therein, the at least one flexible coupler is insertable into the slot of the entertainment component housing, and each of the first positioner and the second positioner being engageable with the entertainment component housing.

In an alternative embodiment, an infant positioner according to the present invention includes a support structure comprising a seat support; and a ground engaging portion engageable with a support surface, the seat support being pivotally coupled to the ground engaging portion such that the support structure is disposable in a deployed configuration, the ground engaging portion including a pair of straps coupled thereto; and a tray mountable to the ground engaging portion, the tray including a mounting component; a seat coupled to the seat support; and an entertainment component removably coupleable to the support structure, the entertainment component being placeable in a first position in which the entertainment component is mounted on the tray and engages the mounting component of the tray, and in a second position in which the entertainment component receives the pair of straps and is spaced apart from the support structure.

In another embodiment, the entertainment component includes a housing defining a pair of slots, each of the slots is configured to receive one of the straps coupled to the ground engaging portion. Alternatively, the entertainment component includes a pivotally mounted stand coupled to the housing, the stand supporting the housing when the entertainment component receives the straps and is placed in its second position.

Other systems, apparatuses, methods, features, and advantages will be, or will become, apparent to one with skill in the art upon examination of the following figures and detailed description. All such additional systems, apparatuses, methods, features, and advantages are included within this description, are within the scope of the claimed subject matter.

BRIEF DESCRIPTION OF THE DRAWINGS

The infant positioner presented herein may be better understood with reference to the following drawings and description. It should be understood that some elements in the figures may not necessarily be to scale and that emphasis has been placed upon illustrating the principles disclosed herein. In the figures, like-referenced numerals designate corresponding parts throughout the different views.

DETAILED DESCRIPTION OF THE INVENTION

An infant positioner according to the present invention may have a support structure that is configured to support an infant. An entertainment component is useable with the infant positioner in different positions. The entertainment component can be coupled to the support structure and placed relative to the support structure in at least a first position and a second position different from the first position. In an alternative embodiment, the entertainment component can be placed in a third position while coupled to the support structure, the third position being different from the first position and the second position. The entertainment component remains coupled to the support structure of the infant positioner while the entertainment component is in any of the first position, the second position, and the third position.

Figure 1:
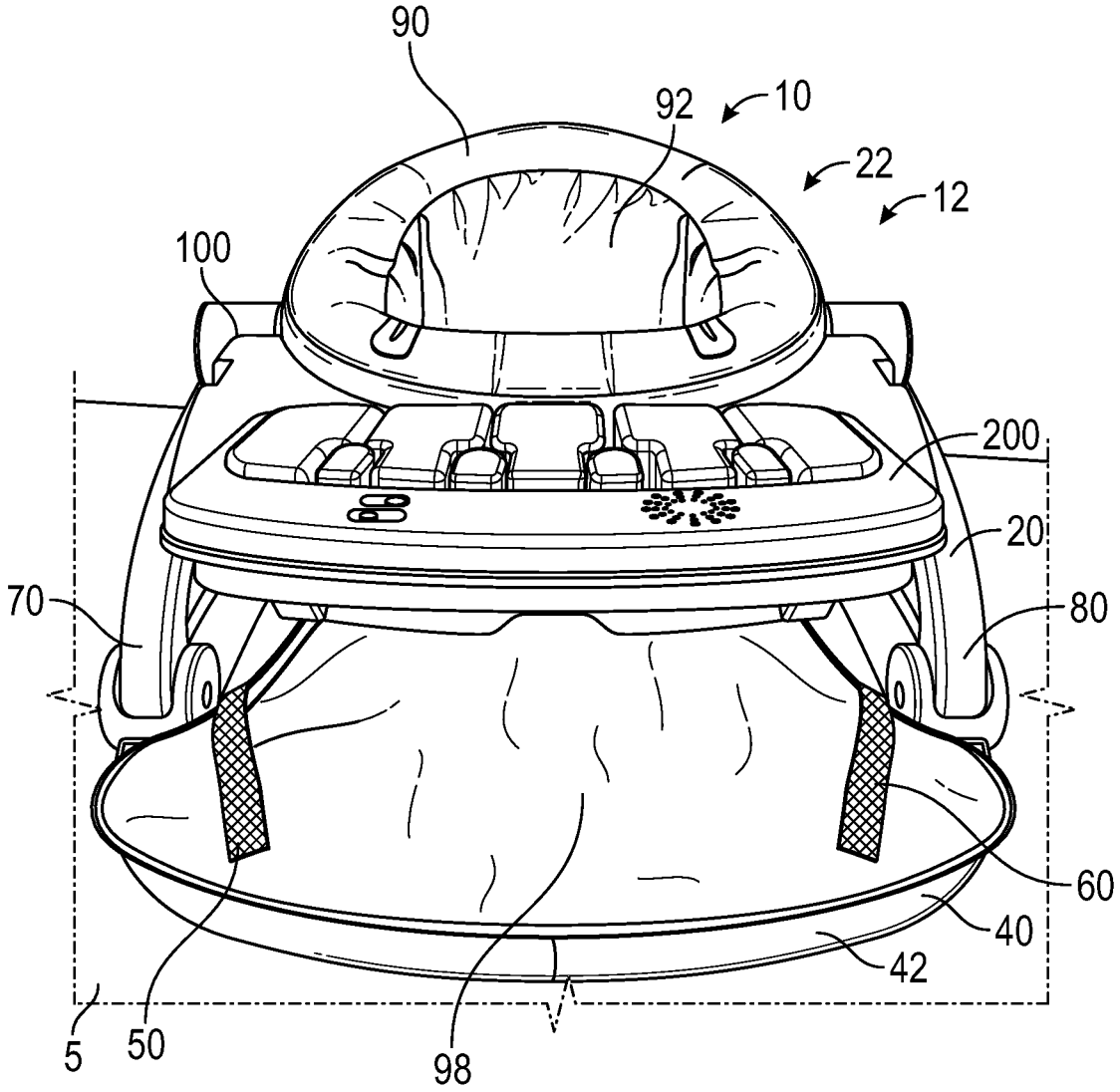
FIG. 1 illustrates a front perspective view of an infant positioner in a first configuration in accordance with an example embodiment of the present disclosure.

Referring to FIG. 1, a front perspective view of an exemplary embodiment of an infant positioner according to the present invention is illustrated. Infant positioner 10 is a reconfigurable infant support structure that can be placed onto a support surface 5. The infant positioner 10 has a deployed configuration 22 as shown in which the infant positioner 10 can receive and support an infant relative to the support surface 5. In one embodiment, the infant positioner 10 has features similar to those of the foldable infant positioner described in U.S. Pat. No. 9,370,257, the entire disclosure of which is incorporated herein by reference in its entirety. As the disclosure of that patent is incorporated herein, only certain components and aspects of the support structure of the infant positioner 10 are discussed herein. For example, while not shown in the FIGS. of this patent application, the infant positioner 10 can be folded down or reconfigured to a collapsed configuration that facilitates travel and storage of the infant positioner 10. Multiple, different configurations of infant positioner 10 are illustrated and described in this application, and in each of those configurations, the support structure of the infant positioner 10 retains its deployed configuration 22, but the entertainment component, described in greater detail below, is moved to a different position relative to the support structure.

Figure 2:
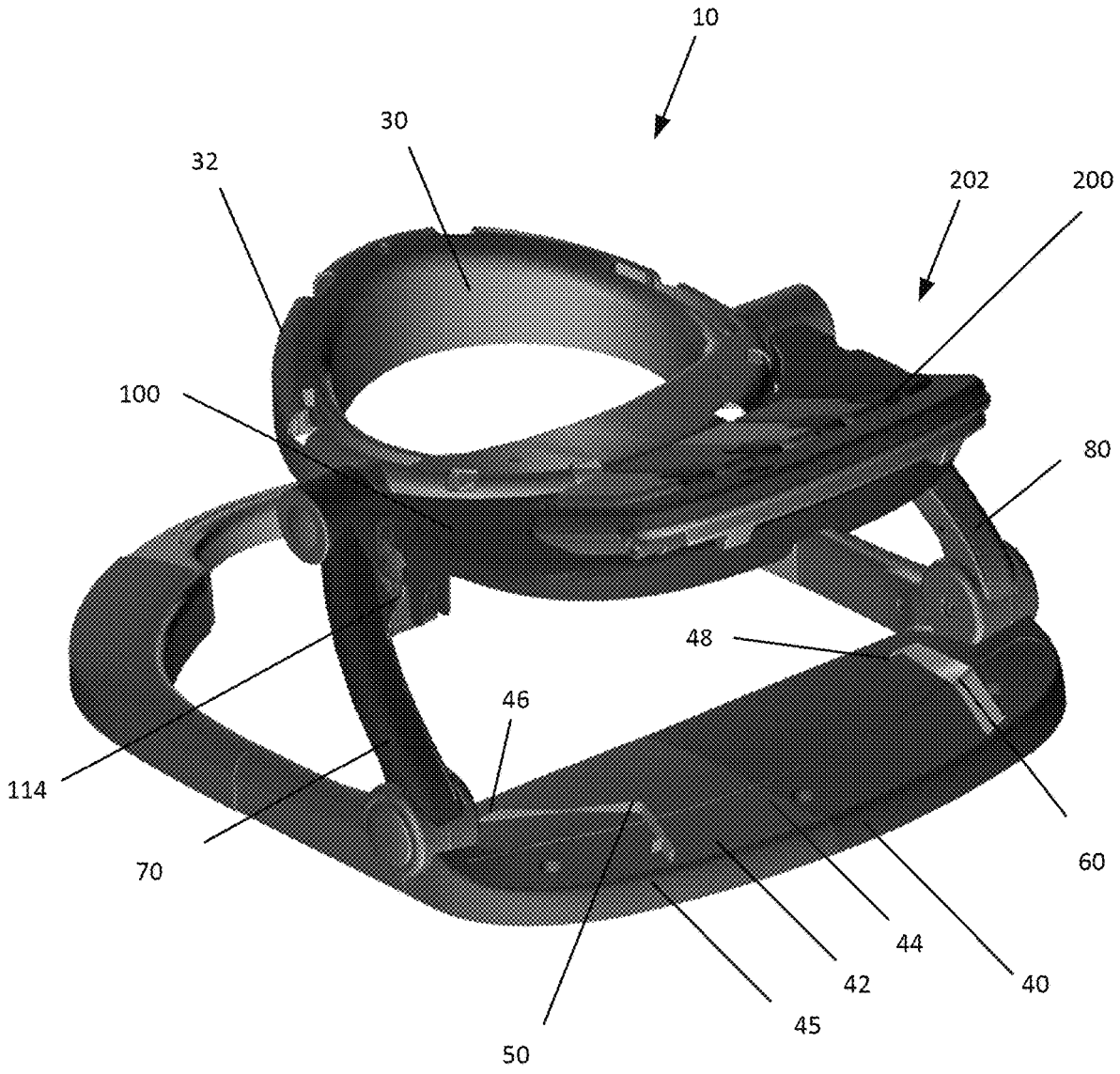
FIG. 2 illustrates a side perspective view of the infant positioner illustrated in FIG. 1 with the softgoods seat and flap removed.

Referring to FIGS. 1 and 2, the infant positioner 10 is illustrated in a first configuration 12. In FIG. 2, the softgoods of the infant positioner 10 that are illustrated in FIG. 1 have been removed, thereby facilitating the viewing of the frame components of the infant positioner 10. The infant positioner 10 includes a support structure 20 that can be placed onto a support surface 5. The support structure 20 includes a seat support 30 that is pivotally coupled to a pair of support arms 70 and 80, that are in turn pivotally coupled to a ground engaging portion 40 that is placeable onto a support surface 5. Similar to the discussion of the pivoting connections in the infant positioner in U.S. Pat. No. 9,370,257, infant positioner 10 can be folded from the deployed configuration 22 illustrated in FIGS. 1 and 2 down to a collapsed configuration.

As shown in FIG. 1, the ground engaging portion 40 includes a base 42 to which the pivotable support arms 70 and 80 are coupled. The base 42 and the ground engaging portion 40 has a periphery 45 (see FIG. 2). The seat support 30 has a periphery 32 (see FIG. 2) about the seat support 30. The ground engaging portion 40 extends beyond the periphery 32 of the seat support 30, which provides stability to the infant positioner 10. In addition, the periphery 45 of the ground engaging portion 40 extends beyond the periphery 32 of the seat support 30.

In this embodiment, the support structure 20 of the infant positioner 10 includes a seat 90 defined by softgoods 92 that can be mounted or coupled to the seat support 30. The seat 90 is configured to receive and support an infant (not shown) therein. The infant positioner 10 includes a softgoods flap or piece of material 98 that is located below the seat support 30 and that is configured to be engaged by the feet of an infant in the seat 90.

The infant positioner 10 includes a tray 100 that is removably coupleable to the support structure 20, and in particular, to the support arms 70 and 80. As shown in each of FIGS. 1 and 2, an entertainment component 200 can be coupled to the tray 100, which enables a young infant seated in the infant position 10 to reach the entertainment component 200 in this configuration. The entertainment component 200 can have several features that can be engaged by an infant, as described below. The entertainment component 200 is illustrated in FIGS. 1 and 2 in a first position 202 in which the entertainment component 200 is mounted onto the tray 100 of the infant positioner 10. In this position 202, the entertainment component 200 is located to be within the reach of an infant supported in seat 90. As a result, an infant in seat 90 and supported by support structure 20 can play with and be entertained by the entertainment component 200. In one embodiment, the entertainment component 200 includes several movable keys and an electronic system connected to the keys. When the infant presses on one of the keys, an audible sound, such as a musical note, is generated by the electronic system. In this position 202, the keys of the entertainment component 200 can be pressed by the hands of an infant in the support structure 20.

Referring to FIG. 2, each support arm 70 and 80 includes a connector assembly (only connector assembly 114 of support arm 70 is illustrated in FIG. 2). The connector assemblies of the support arms 70 and 80 are used to couple or mount the tray 100 to the support arms 70 and 80. The manner in which the tray 100 is mounted to the support arms 70 and 80 is described in greater detail below.

Also shown in FIG. 2 is a pair of couplers 50 and 60 that are connected to the ground engaging portion 40. In this embodiment, the couplers 50 and 60 are flexible couplers or straps that are identical, and one end of each coupler 50 and 60 is inserted into one of the slots 46 and 48 formed in the body 44 of the ground engaging portion 40. Each of the couplers 50 and 60 is secured therein against any disconnection from the ground engaging portion 40. The couplers 50 and 60 are engageable with the entertainment component 200 to retain the entertainment component 200 in different positions relative to the support structure 20 of the infant positioner 10 proximate the feet of an infant supported in the support structure 20. When the entertainment component 200 is coupled to couplers 50 and 60, an infant in the support structure 20 can engage the keys of the entertainment component 200 using the infant's feet.

Figure 3:
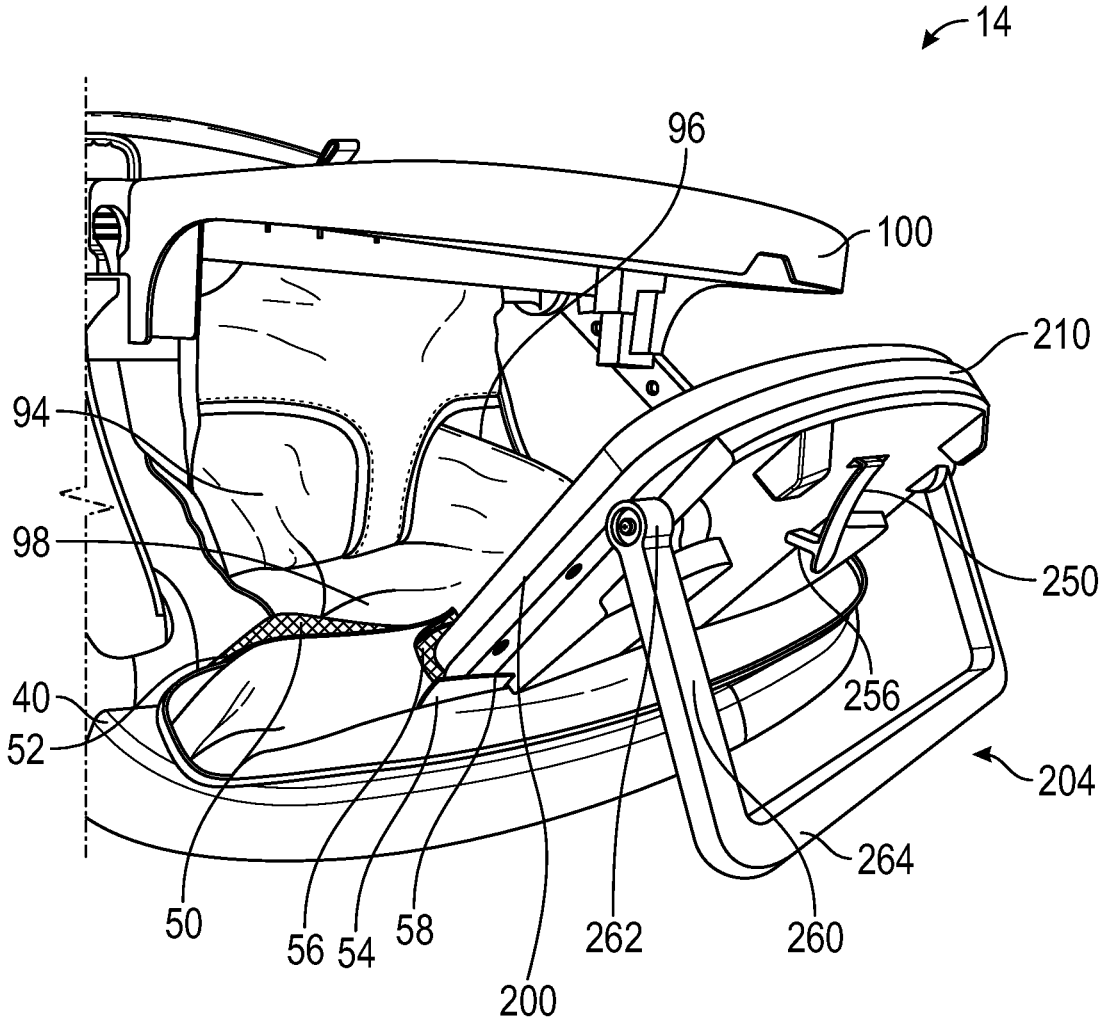
FIG. 3 illustrates a close-up perspective view of part of the infant positioner illustrated in FIG. 1 in a second configuration.
Figure 4:
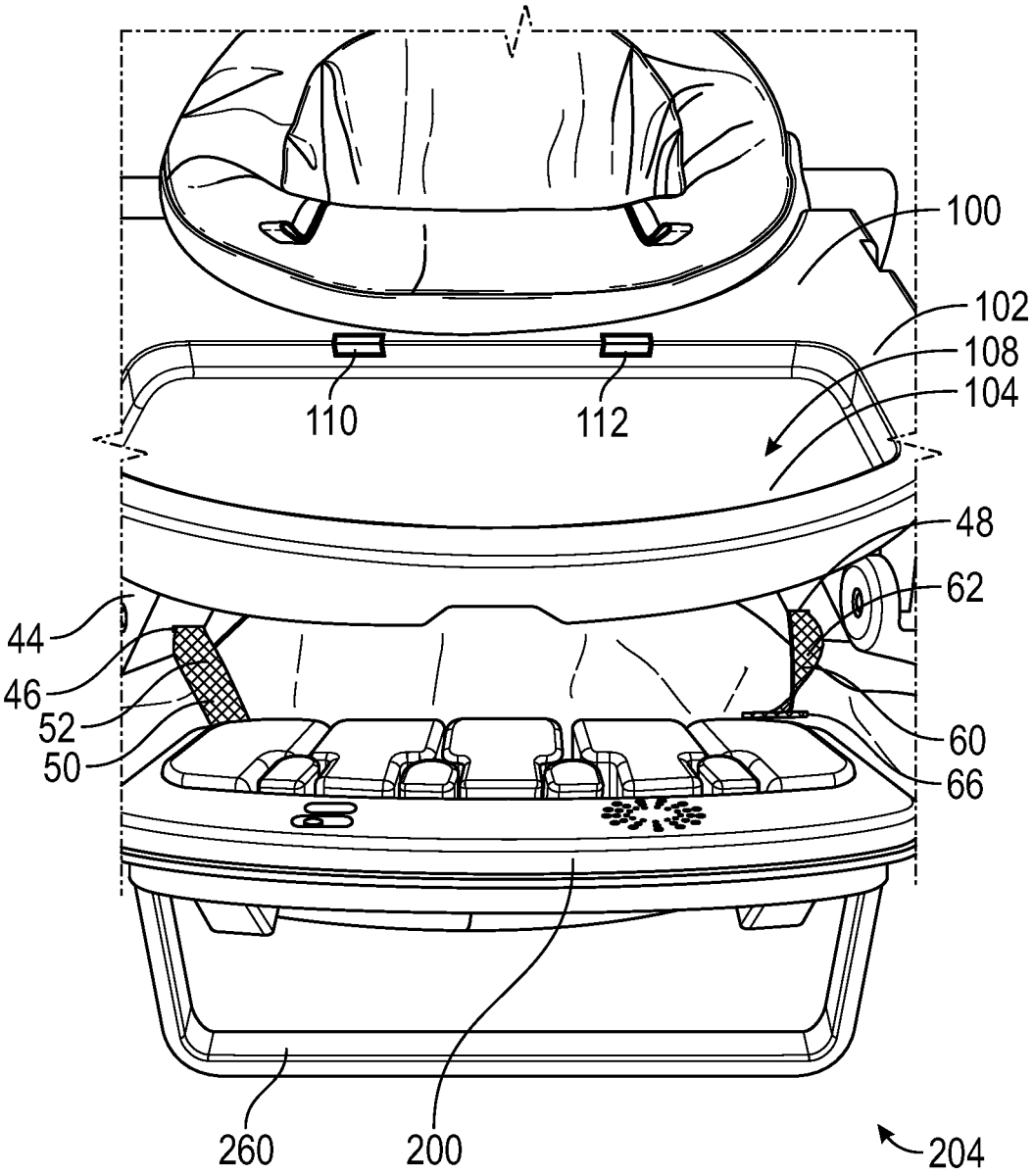
FIG. 4 illustrates a front perspective view of the infant positioner illustrated in FIG. 3.

Turning to FIGS. 3 and 4, the entertainment component 200 is illustrated as having been removed from the tray 100 and moved to its lower position 204, in which an infant's feet can engage the keys of the entertainment component 200. This location of entertainment component 200 is used for older age infants. Referring to FIG. 3, the infant positioner 10 is illustrated in a second configuration 14 in which the entertainment component 200 has been decoupled from the tray 100. The entertainment component 200 includes a housing 210 to which a support stand 260 is pivotally coupled. In this embodiment, the support stand 260 has a general U-shape with a first end 262 (the legs of the U) pivotally coupled to the housing 210 via connectors such as bolts or screws. The support stand 260 has a second end 264 that is spaced away from the housing 210 when the support stand 260 is opened up, thereby providing support for the entertainment component 200.

The entertainment component 200 includes a mounting strap 250 that is coupled to the housing 210 and extending from a rear surface of the housing 210. The mounting strap 250 has a free end 256 that can be moved by a user to reposition the mounting strap 250 depending on the particular position of the entertainment component 200.

FIG. 3 also illustrates the engagement of coupler 50 with entertainment component 200. It is to be understood that the following description of coupler 50 applies to coupler 60, which also engages the entertainment component 200. In this embodiment, coupler 50 has a mounted or fixed end 52 that is coupled to the ground engaging portion 40 as described above relative to FIG. 2. The coupler 50 is mounted so that it has a free end 54 that can be moved by the user. In one embodiment, the coupler 50 is a flexible strap or web that has a first positioner or tab 56 and a second positioner or tab 58. The free end 54 of the coupler 50 is inserted into and passed through a slot on the housing 210 of the entertainment component 200.

As shown in FIG. 3, the free end 54 of the coupler 50 has been inserted through the housing 210 and the second positioner 58 is located on the rear side of the housing 210. The second positioner 58 is formed by stitching a relatively short portion of the coupler or strap 50 to the main body of the coupler or strap 50, thereby creating a laterally extending tab or flap 54 that prevents the coupler 50 from easily sliding through the slot of the housing 210 and disconnecting therefrom. Due to the location of the second positioner 58 on the rear side of the housing 210, the entertainment component 200 stays in its position 204 and coupled to the strap 50, even when an infant in the support structure 20 is kicking the entertainment component 200 with the infant's feet. As a result, the entertainment component 200 remains coupled to the support structure 20 via couplers 50 and 60. When the infant engages the entertainment component 200 using the infant's feet, audible outputs, such as music, are generated.

In addition, the entertainment component 200 in its lower position 204 illustrated in FIG. 3 is located beyond the periphery 32 of the seat support 30 and beyond the periphery 45 of the ground engaging portion 40. In this position 204, the entertainment component 200 is beyond both peripheries 32 and 45, and can be seen by an infant located in seat support 30. This lower position 204 usage allows for the advancement in usage of the entertainment component 200 by older infants. In the lower position 204, the entertainment component 200 is disposed at an angle relative to the support surface, thereby facilitating the viewing thereof by an infant in the infant support structure 10. The entertainment component 200 can be moved relative to the infant support structure 10 and placed in several positions.

The softgoods 92 of the seat 90 of the infant positioner 10 includes a pair of openings 94 and 96, each of which is sized and configured to receive a leg of an infant located in the seat 90 and supported by the softgoods 92.

Turning to FIG. 4, each of the couplers or straps 50 and 60 is illustrated. As shown, couplers 500 have mounted ends 52, 62 and free ends 54, 64, respectively. Similar to coupler 50, coupler 60 has two positioners as well that are used to locate the housing 210 of the entertainment component 200. While only first positioner or tab 66 of coupler 60 is illustrated in FIG. 4, it is to be understood that the second positioner of the coupler 60 is located on the rear side of entertainment component 200.

Referring to FIG. 4, details of the tray 100 are illustrated. In this embodiment, the tray 100 includes a housing 102 that has an upper surface 104 that defines a cavity 108. Proximate to an edge of the cavity 108 is a pair of spaced-apart mounting components or tabs 110 and 112. The mounting components 110 and 112 are used to couple the entertainment component 200 to the tray 100, as described in greater detail below.

Figure 5:
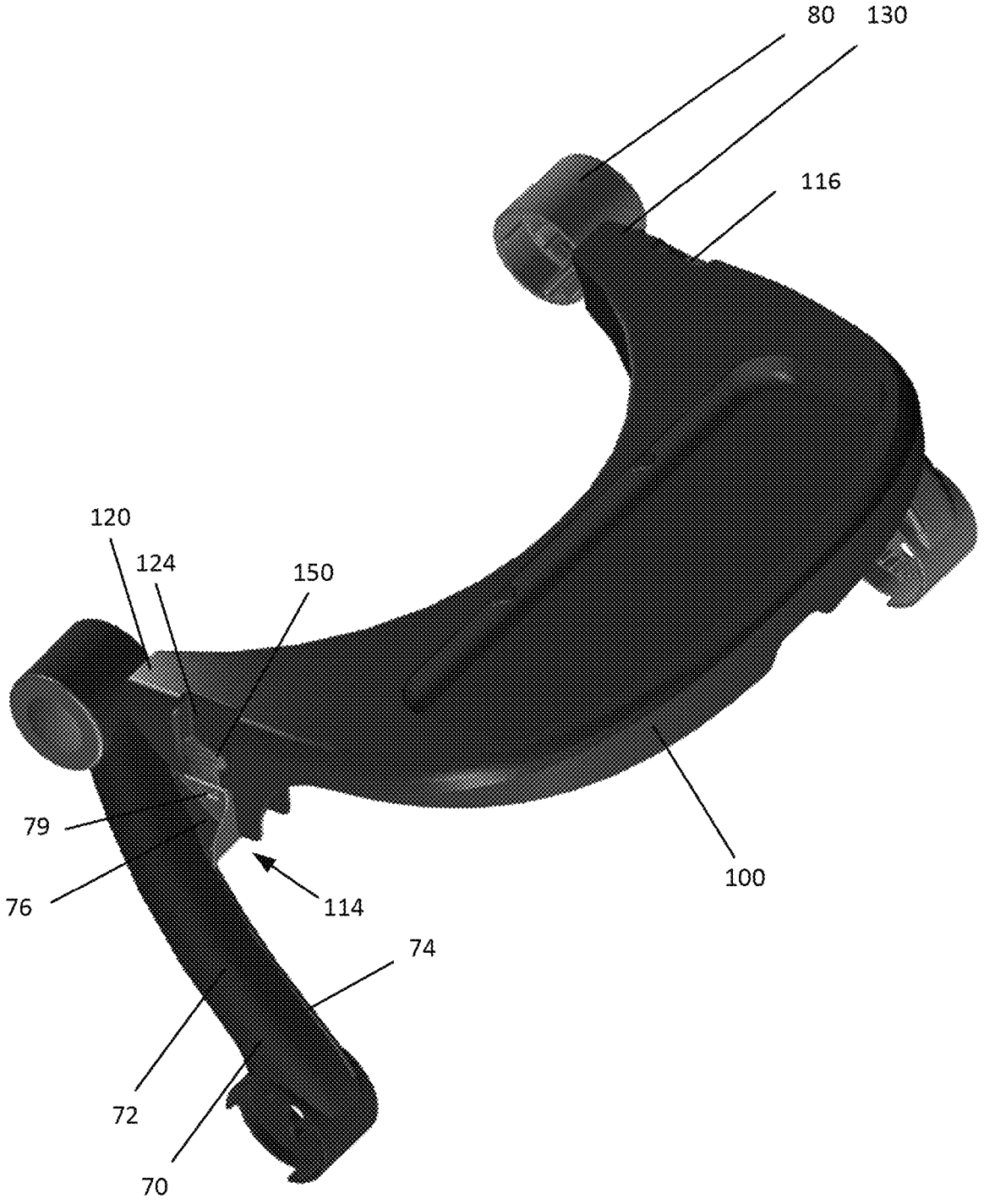
FIG. 5 illustrates a perspective view of the support arms and tray of the infant positioner illustrated in FIG. 1.
Figure 6:
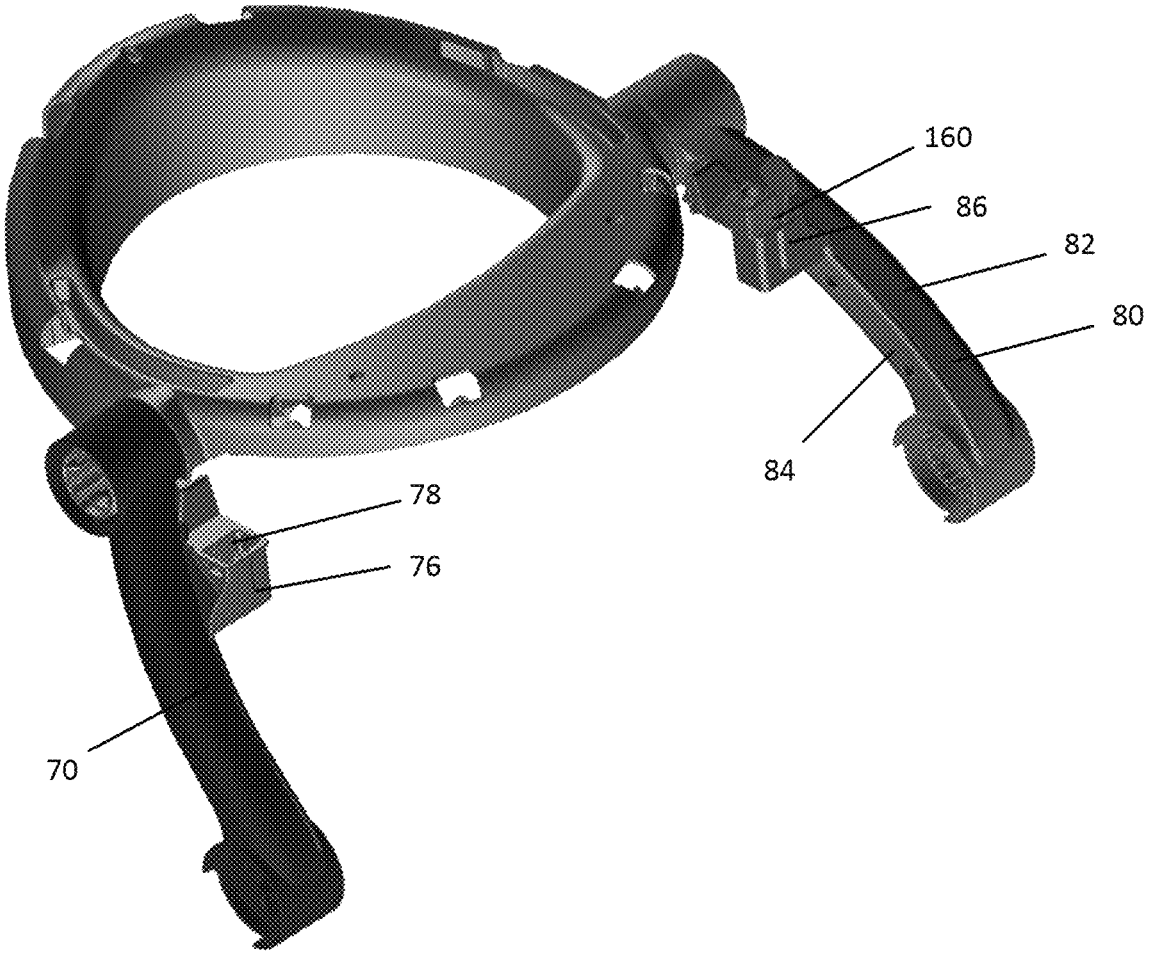
FIG. 6 illustrates a perspective view of the support arms and seat of the infant positioner illustrated in FIG. 1.

However, prior to discussing the mounting of the entertainment component 200 to the tray 100, the mounting of the tray 100 to the support structure 20 is discussed first. The mounting of the tray 100 to the support structure 20 is illustrated in FIGS. 5-11. Turning to FIGS. 5 and 6, the support arms 70 and 80 of the support structure 20 are shown. The support arms 70 and 80 are mirror images of each other.

In FIG. 5, support arm 70 includes an outer housing 72 and an inner housing 74 that are coupled together using connectors, such as screws. Integrally formed as part of inner housing 74 is a connector 76 to which the tray 100 is coupled. The connector 76 defines a receptacle 78 (see FIG. 6). In FIG. 6, support arm 80 includes an outer housing 82 and an inner housing 84 that are coupled together using connectors, such as screws. Integrally formed as part of inner housing 84 is a connector 86 to which the tray 100 is also coupled. In other embodiments, either or both of the connectors 76 and 86 can be formed separately from inner housings 74 and 84 and subsequently coupled thereto.

Referring back to FIG. 5, the tray 100 includes arm portions 120 and 130 at opposite ends of a central body portion. The arm portions 120 and 130 include connector assemblies 114 and 116, respectively, that are coupled to support arms 70 and 80, respectively. Proximate arm portion 120 on tray 100 is a groove 124 that is sized and configured to receive part of a connector 150. As discussed below, the connector 150 couples the tray 100 to the connector 76 on support arm 70. While not shown in FIG. 5, in this embodiment, the tray 100 includes another groove that is proximate arm portion 130 and that is configured to receive part of a different connector that connects the tray to the connector on support arm 80.

Turning to FIG. 6, a connector 160 is illustrated as being engaged with support arm 80. Tray 100 has not been illustrated in FIG. 6 to facilitate the description of the illustrated components. While not shown in FIG. 6, the connector 160 is coupled to the lower surface of the tray 100 via a connector, such as a screw. Once connector 160 is coupled to tray 100, the connector 160 can be inserted into the connector 86 of support arm 80, thereby coupling the tray 100 to the support arm 80.

Figure 7:
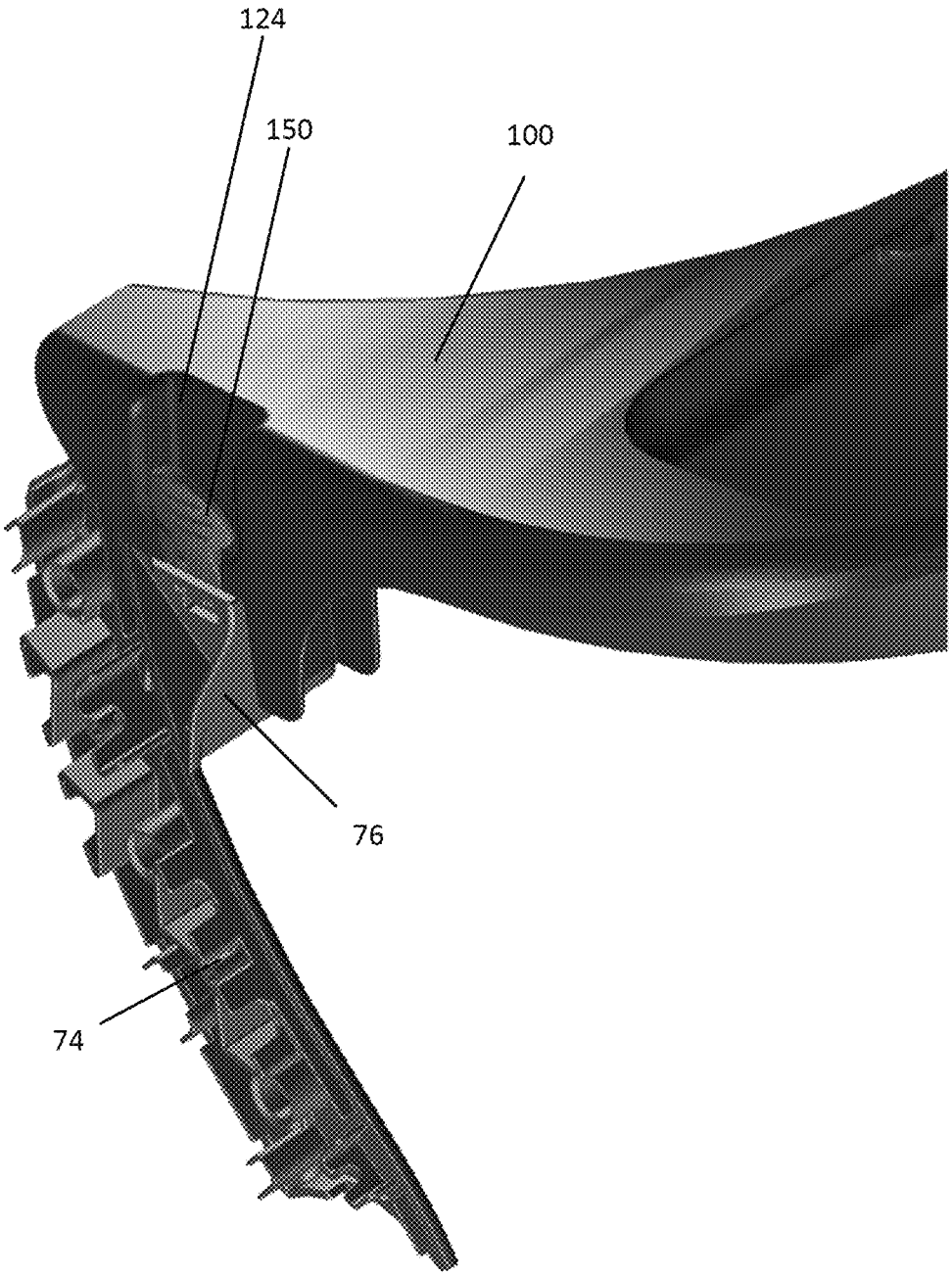
FIG. 7 illustrates a close-up perspective view of part of a support arm and part of a tray of the infant positioner illustrated in FIG. 1.

Referring to FIG. 7, a portion of support arm 70 and a portion of tray 100 are illustrated. The outer housing 72 of support arm 70 has been removed for this illustration, thereby revealing the inner housing 74 of support arm 70. As shown, the connector 76 of support arm 70 is integrally formed with inner housing 74. Connector 150 is fixedly coupled to the lower surface of tray 100 by a connector, such as a screw. Thus, once connector 150 is coupled to tray 100, connector 150 can be inserted into a receptacle 78 in connector 76 of support arm 70. Each of the connectors 150 and 160 can be decoupled from a corresponding support arm 70 and 80 by a user engaging a release tab on the particular connector or connectors, the structure of which will now be described relative to FIGS. 8-10.

Figure 8:
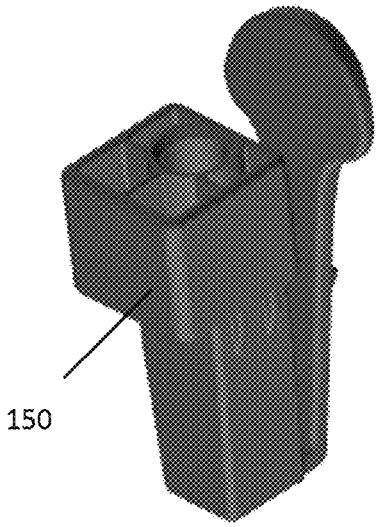
FIGS. 8 and 9 illustrates front and rear perspective views of a connector of the infant positioner illustrated in FIG. 1.
Figure 9:
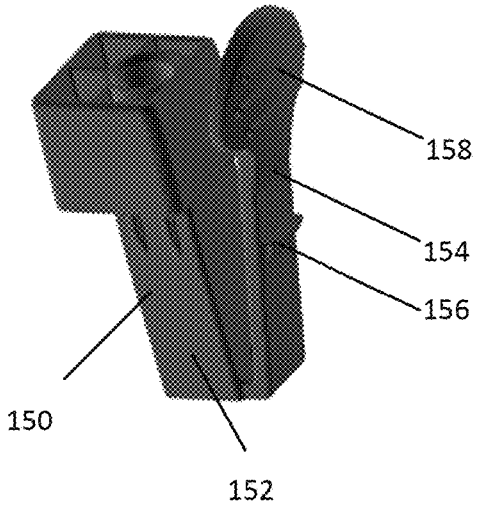
Figure 10:
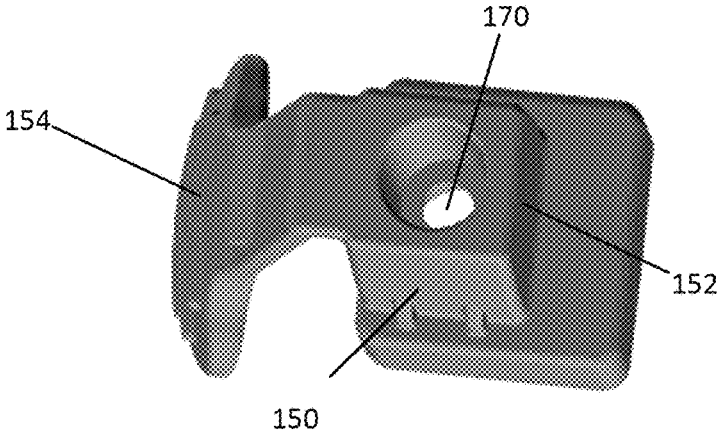
FIG. 10 illustrates a bottom perspective view of the connector illustrated in FIGS. 8 and 9.

Referring to FIGS. 8-10, different perspective views of an embodiment of a connector according to the present invention are illustrated. Connector 150 is illustrated in FIGS. 8-10, and it is to be understood that connector 160 has a configuration and function similar to that of connector 160. As shown, connector 150 has a body 152 that is configured to be inserted into the receptacle 78 of support arm connector 76, and a flexible tab 154 resiliently biased and coupled to the body 152 via a living hinge. The flexible tab 154 is also inserted into the receptacle 78 of support arm connector 76 along with the body 152. The flexible tab 154 includes a locking ridge 156 that engages a notch in the connector 76 to secure the connector 150 and tray 100 to support arm 70.

The flexible tab 154 also includes several gripping ridges 158 that facilitate the movement of the flexible tab 154 by the engagement of a user's finger, such as a thumb. When a user wants to decouple the connector 150 from the support arm connector 76, the user pushes the flexible tab 154 inwardly, thereby disengaging the locking ridge 156 from the support arm connector 76. At that point, the user can lift the tray 100 upwardly to remove the connector 150 from the support arm connector 76. Referring to FIG. 10, the body 152 of connector 150 includes a through hole 170 into which a connector, such as a screw, can be inserted to couple the connector 150 to the tray 100.

Figure 11:
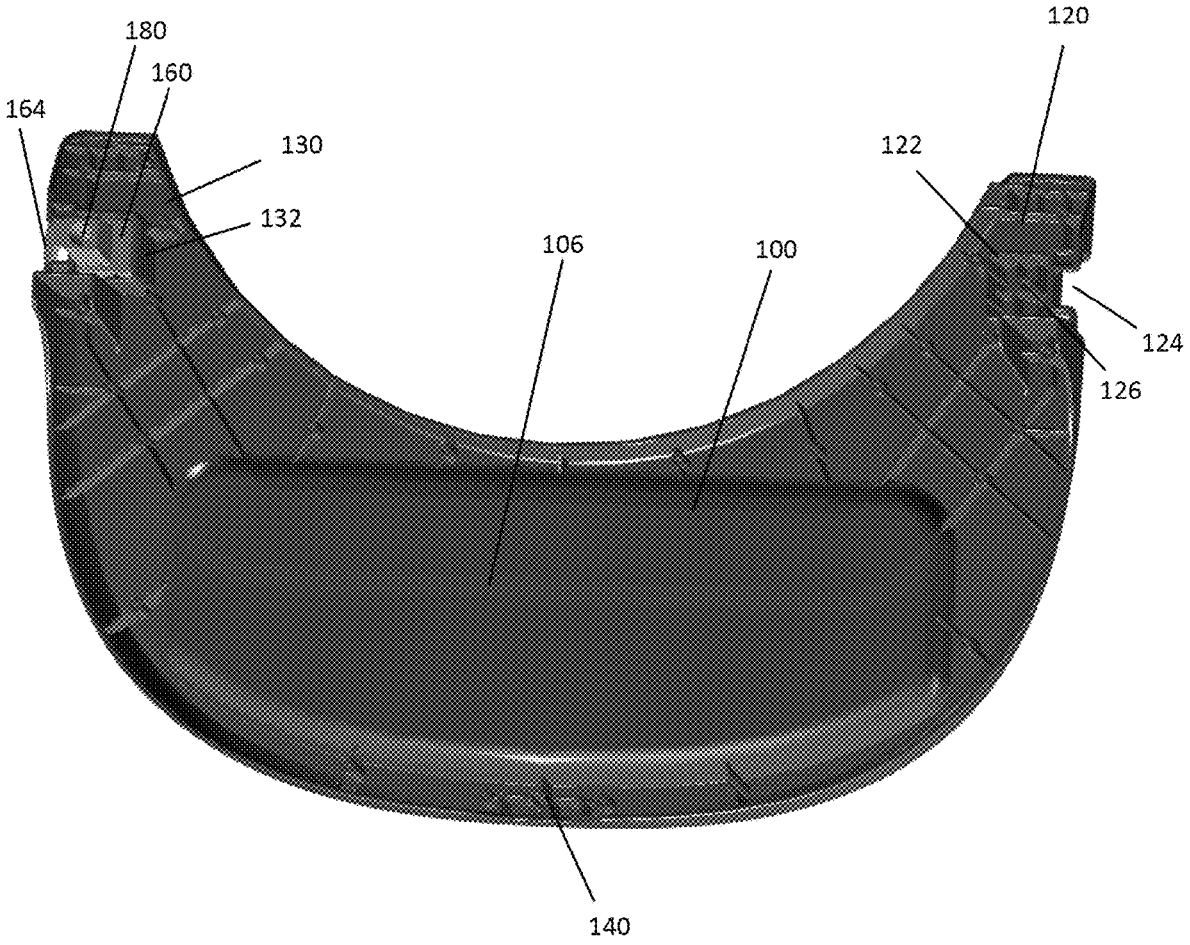
FIG. 11 illustrates a bottom view of the tray of the infant positioner illustrated in FIG. 1.

Referring to FIG. 11, a bottom view of the tray 100 is illustrated. As shown, the tray 100 includes a lower surface 106 that spans from tray arm 120 to tray arm 130. Tray arm 120 includes a wall defining a receptacle 122 into which connector 150 is insertable. Similarly, tray arm 130 includes a wall defining a receptacle 132 into which connector 160 is insertable. Inside of receptacle 122 is a post that defines a hole 126 into which a screw is fastened to couple the connector 150 to the tray 100. In FIG. 11, connector 160 is illustrated as being coupled to tray 100 via a screw 180 that has been inserted into the hole of the body of connector 160 and into a hole on tray 100. The flexible tab 164 of connector 160 is illustrated in FIG. 11. The tray 100 also includes a mounting post 140 that is formed proximate to the front of the tray 100, the function of which is described in detail below.

Figure 12:
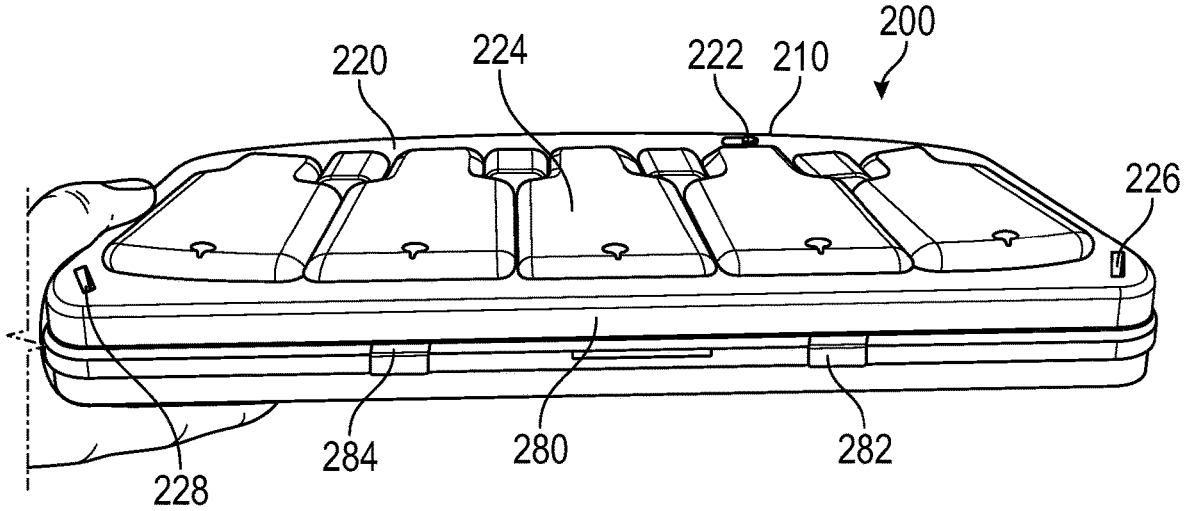
FIG. 12 illustrates a bottom perspective view of the entertainment component of the infant positioner illustrated in FIG. 1.

Details of the entertainment component 200, including the mounting of the entertainment component 200 to the tray 100, are now described with reference to FIGS. 12-18. Turning to FIG. 12, an embodiment of an entertainment component 200 according to the present invention is illustrated. The exact details of the entertainment component 200 can vary in different embodiments, provided that the entertainment component 200 can be mounted to the tray 100 and repositioned spaced apart from the support structure 20 of the infant positioner 10.

In this embodiment, the entertainment component 200 includes a housing 210 with a front or upper surface 220 that has several different components that can be engaged by a user and/or an infant. The front surface 220 includes one or more switches or controls 222 for turning on the entertainment component 200 and controlling the operation thereof. The housing 210 includes several movable keys 224 that when pressed, close switches associated with each of the keys 224. In FIG. 12, the slots 226 and 228 that are located proximate to the lower corners of the housing 210 and extend therethrough are illustrated. Couplers 50 and 60 are inserted through the slots 226 and 228, respectively, as described above relative to FIG. 3. The housing 210 also includes a lower surface 280. Formed in the lower surface 280 are openings or slots 282 and 284 that are configured to receive the mounting tabs 110 and 112, respectively, proximate the cavity 108 of tray 100.

Figure 13:
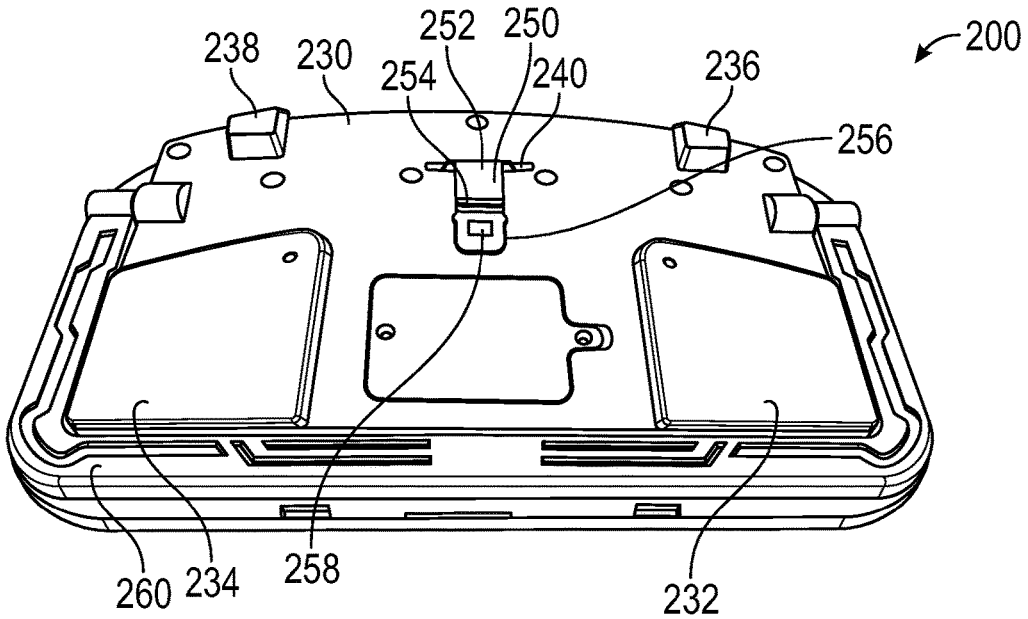
FIG. 13 illustrates a rear view of the entertainment component illustrated in FIG. 12.

Referring to FIG. 13, the lower or rear surface 230 of entertainment component 200 is illustrated. The support stand 260 is shown in its retracted position proximate the housing 210 in FIG. 13. The housing 210 includes a pair of tapered shoulders 232 and 234 that rest on the surface defining the cavity 108 of the tray 100 when the slots 282 and 284 receive the tray mounting tabs 110 and 112 when the entertainment component 200 is positioned on the tray 100. In addition, a pair of feet 236 and 238 that are slightly taller than tapered shoulders 232 and 234 extend from the rear surface 230. The feet 236 and 238 also engage the surface defining the cavity 108 when the entertainment component 200 is positioned on the tray 100. The combination of the tapered shoulders 232 and 234 and the feet 236 and 238 provide four points of support to the housing 210. As a result, the upper surface of the housing 210 is angled relative to the tray 100, which facilitates the interaction by the infant with the entertainment component 200.

A securing strap 250 is coupled to the entertainment component housing 210 to help secure the housing 210 to the tray 100. Also formed in the rear surface 230 of housing 210 is a slot 240. The securing strap 250 is inserted into the slot 240 and a fixed end 252 of the securing strap 250 is retained to the housing 210 via a retainer inside the housing 210. The securing strap 250 also has a free end 254 to which a tab 256 is coupled. In this embodiment, the tab 256 extends substantially perpendicular to the body of the securing strap 250. The tab 256 includes an opening 258 formed therein as well.

Figure 14:
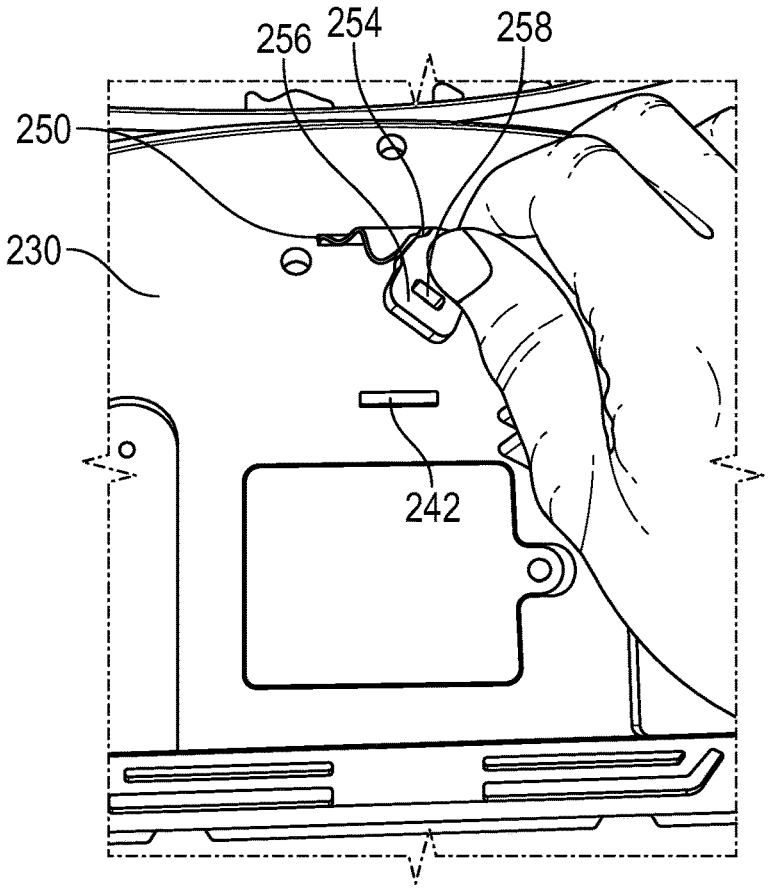
FIG. 14 illustrates a close-up rear view of the entertainment component illustrated in FIG. 13 with the strap ready to be inserted into a slot on the entertainment component.
Figure 15:
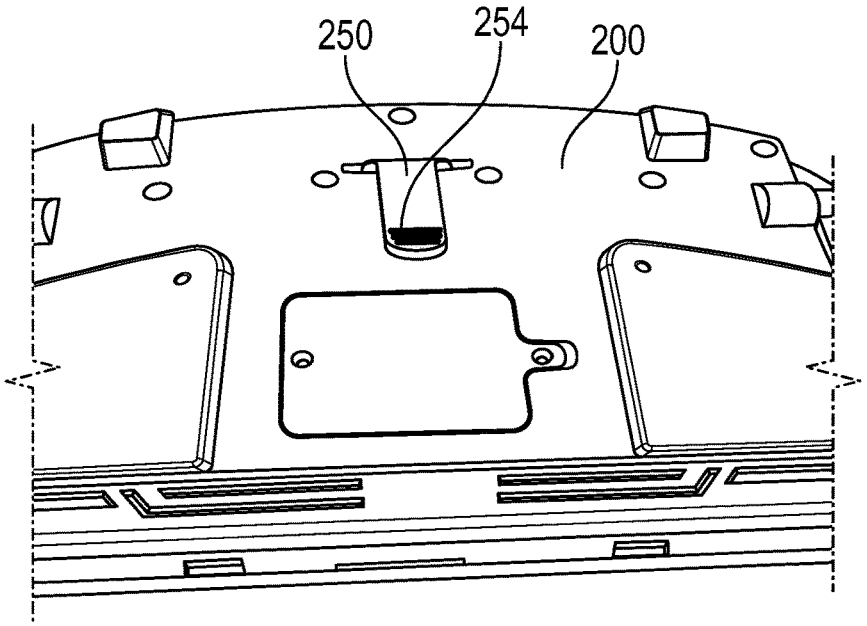
FIG. 15 illustrates a close-up rear perspective view of the entertainment component illustrated in FIG. 14 with the strap inserted into a slot on the entertainment component.

Referring to FIG. 14, a user is gripping the free end 254 of the securing strap 250 and is moving the tab 256 proximate slot 242 in housing 210. Slot 242 is sized to receive the tab 256 and retain it therein via friction. Referring to FIG. 15, the tab 256 has been inserted into slot 242. In this position, the securing strap 250 is proximate to the rear surface 230 of the entertainment component 200. The securing strap 250 is moved to this position when the entertainment component is decoupled from the tray 100 and used remotely from the tray 100 and support structure 20.

Figure 16:
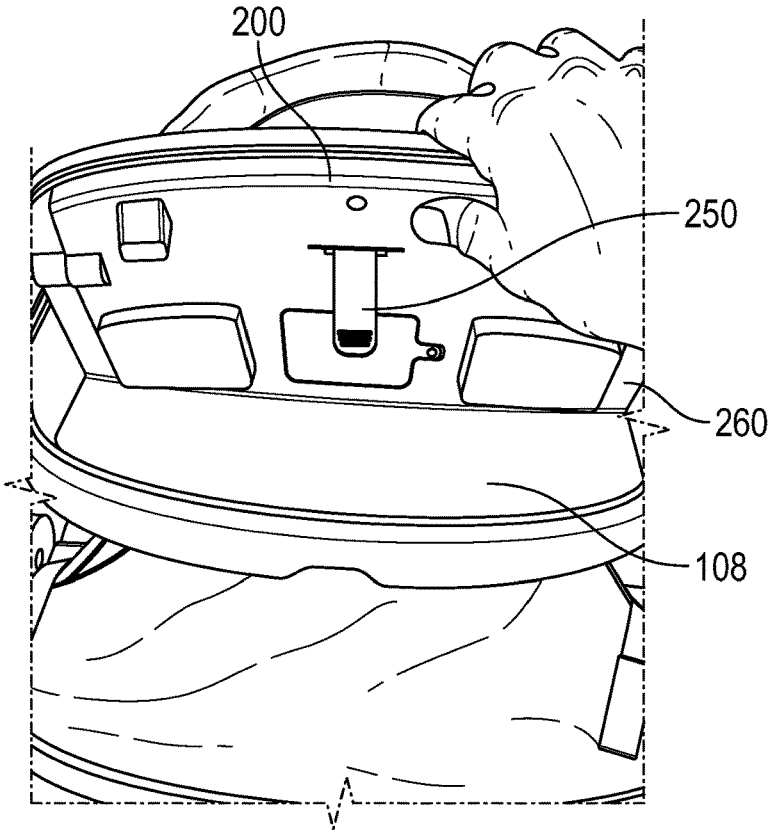
FIG. 16 illustrates a top front view of the entertainment component in an intermediate position relative to the tray of the infant positioner illustrated in FIG. 1.
Figure 17:
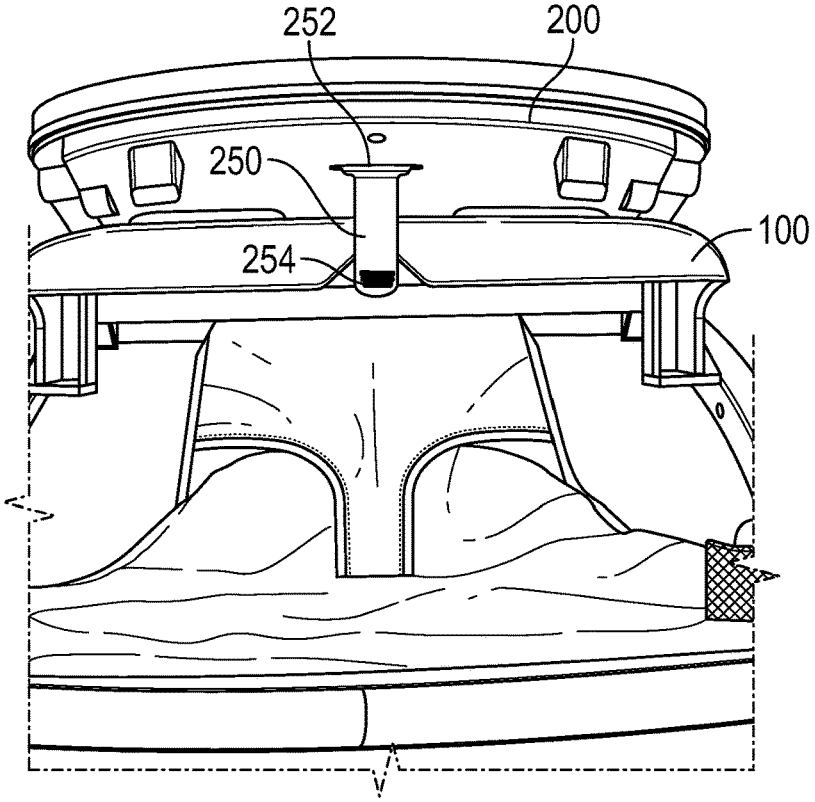
FIG. 17 illustrates a bottom front view of the infant positioner illustrated in FIG. 1 with the entertainment component coupled to the tray.

Turning to FIGS. 16 and 17, the mounting of the entertainment component 200 to the tray 100 is illustrated according to the present invention. In FIG. 16, the entertainment component 200 is illustrated in an intermediate position during the mounting of the entertainment component 200 to the tray 100. As shown, the securing strap 250 coupled to the housing 210 of the entertainment component 200 has been decoupled from the rear surface 230 by removing the tab 256 from slot 242, the opposite step compared to that discussed relative to FIG. 14. In addition, the support stand 260 is moved to its retracted position proximate to housing 210, which allows the entertainment component 200 to be placed in cavity 108 of tray 100.

The entertainment component 200 is placed in the cavity 208 and slid until the mounting tabs 110 and 112 are inserted into slots 282 and 284, respectively. Referring to FIG. 17, the entertainment component 200 has been slid into its mounting position on the tray 100. The free end 254 of the securing strap 250 is loose and is pulled outwardly to the outer edge of the tray 100.

Figure 18:
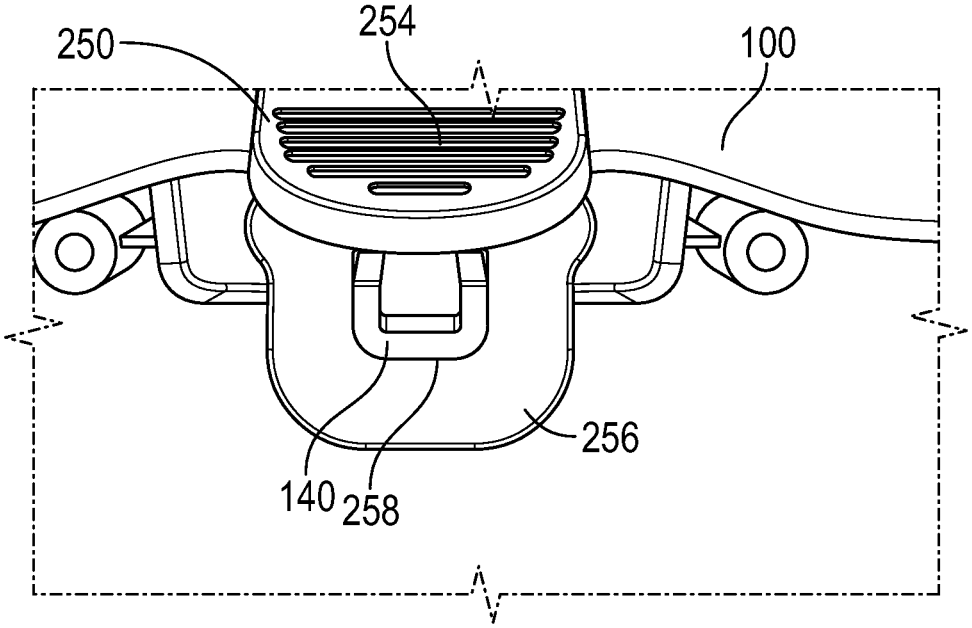
FIG. 18 illustrates a close-up view of the strap of the entertainment component coupled to the tray of the infant positioner illustrated in FIG. 17.

Turning to FIG. 18, the tab 256 of the securing strap 250 is placed so that the opening 258 of the tab 256 receives the mounting post 140 of the tray 100. The tab 256 is slid onto the mounting post 140 as shown. A user can grip the free end 254 to manipulate the tab 256 over the post 140. When the securing strap 250 is coupled to the post 140 on the tray 100, the entertainment component 200 is coupled to the tray 100 via three items: mounting tabs 110 and 112 in slots 282 and 284 and securing tab 256 on securing post 140, in addition to the four points of contact (the angled surfaces and the feet). These three couplings secure the entertainment component 200 in its use position on the tray 100.

Figure 19:
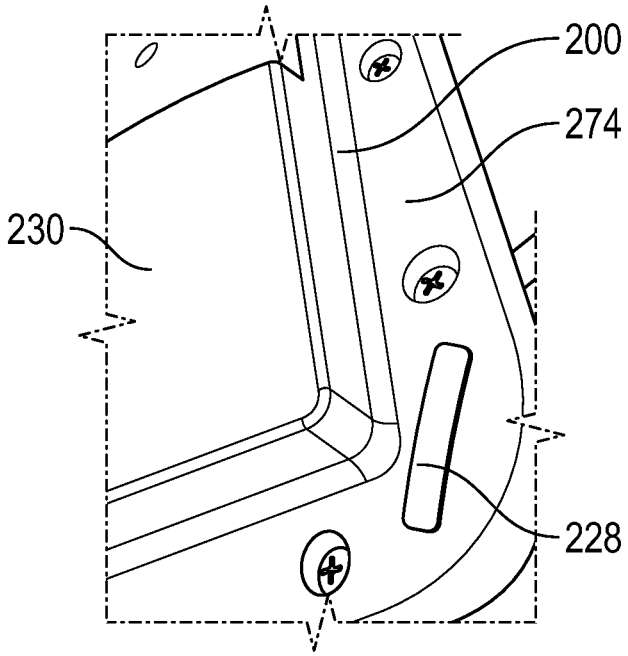
FIG. 19 illustrates a close-up rear perspective view of the entertainment component of the infant positioner illustrated in FIG. 1.

The features that relate to the location of the entertainment component 200 in its second position or its third position spaced apart from the tray 100 and proximate the feet of an infant are discussed now relative to FIGS. 19-22. Referring to FIG. 19, a rear perspective view of a corner of housing 230 of entertainment component 200 is illustrated with support stand having been pivoted to its deployed or extended position. In this position, the rear groove 274 that is sized to receive the support stand when folded is visible. Also shown is slot 228, which extends from the front to the rear of the housing 210.

Figure 20:
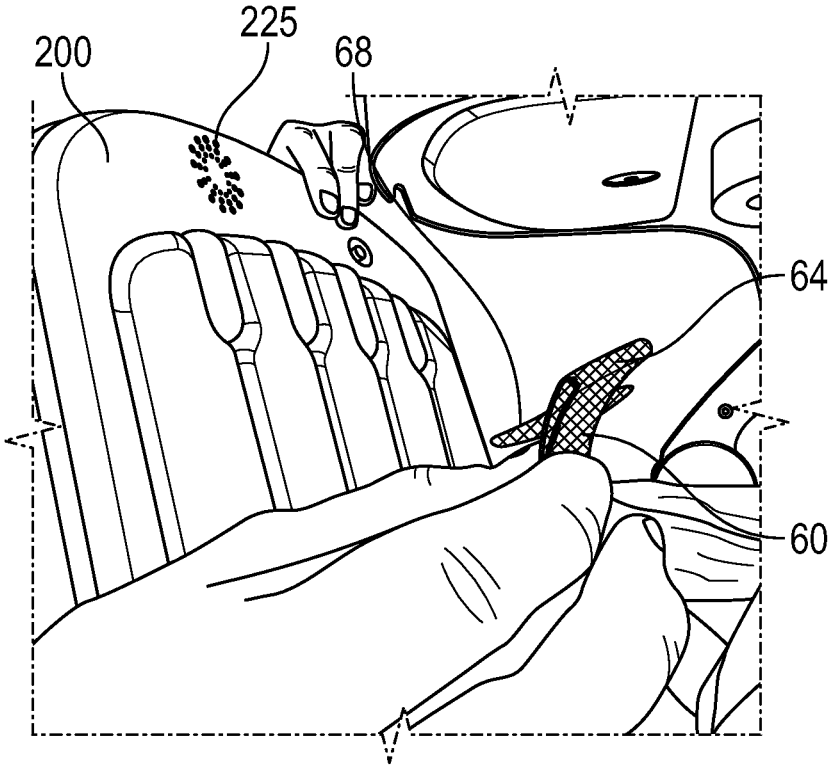
FIG. 20 illustrates a close-up side view of the strap of the infant positioner illustrated in FIG. 1 prior to insertion into the entertainment component.
Figure 21:
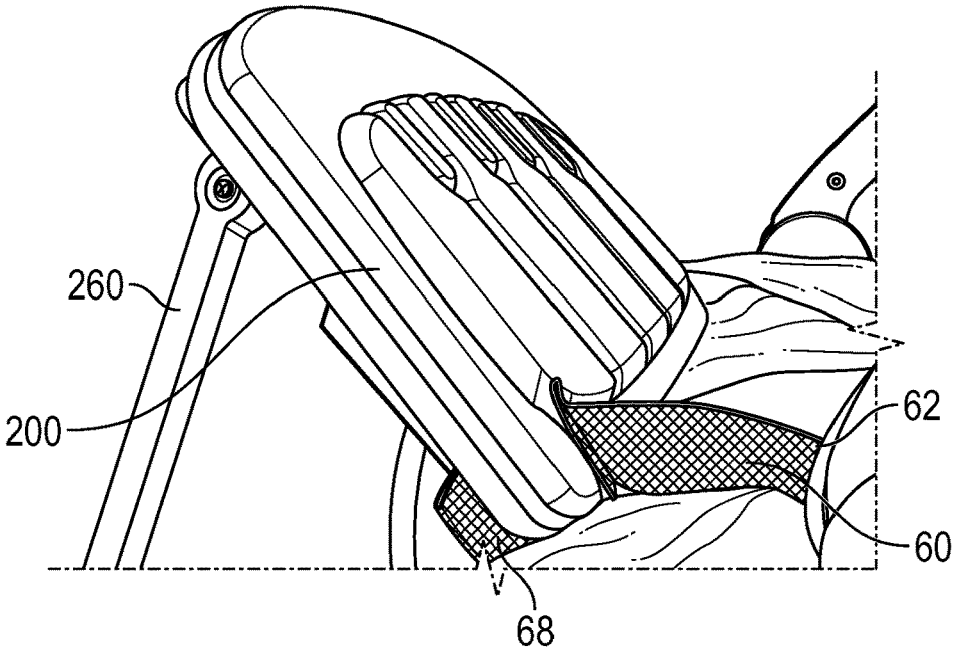
FIG. 21 illustrates a close-up side view of the entertainment component and strap illustrated in FIG. 20 with the strap inserted into a slot on the entertainment component.
Figure 22:
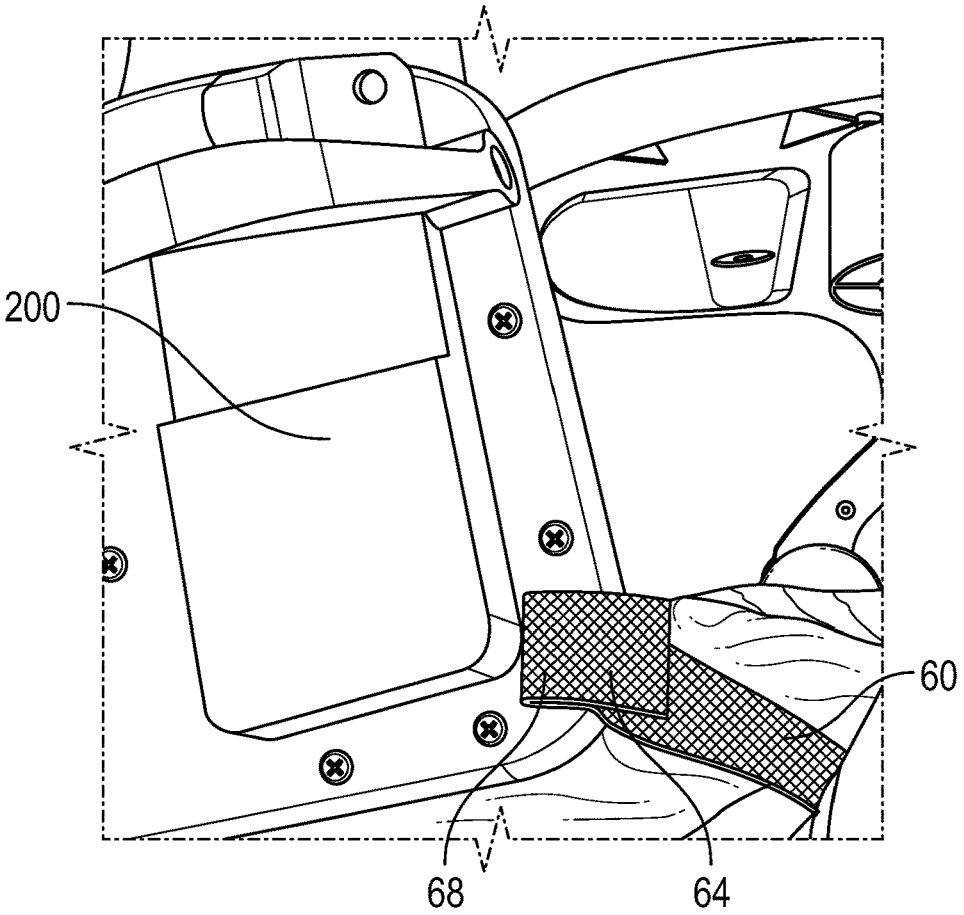
FIG. 22 illustrates a close-up rear view of the entertainment component and strap illustrated in FIG. 21.

Referring to FIG. 20, the free end 64 of coupler 60 is shown with second positioner 68 visible, prior to being inserted into slot 228. Also shown in FIG. 20 are speaker holes 225 formed in housing 210. Once the strap 60 has been inserted into slot 228, the second positioner 68 is located on the rear side of the housing 210. The second positioner 68 limits the movement of entertainment component 200 away from the support structure 20 when it is contacted or kicked by an infant. If a position closer to the feet of an infant is desired, then the strap 60 is moved further through the slot 228 until the first positioner 66 on strap 60 (and the first positioner 56 on strap 50) is on the rear side of housing 210. Since the first positioners on the straps are closer to the fixed ends of the straps that are coupled to the support structure 20 than the second positioners on the straps, the entertainment component 200 is retained in a closer position when the first positioners are on the rear side of housing 210 than when only the second positioners are on the rear side of housing 210.

If a user wants to move the entertainment component 200 from one of its lower positions to the position on tray 100, the user can fold the positioners 56, 58, 66, and 68 so that they are in contact with the body of each coupler 50 and 60. The couplers 50 and 60 can then be pulled outwardly through slots 226 and 228, thereby disengaging the couplers 50 and 60 from the housing 210.

In the foregoing detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the foregoing detailed description is not to be taken in a limiting sense, and the scope of embodiments is defined by the appended claims and their equivalents.

Aspects of the disclosure are disclosed in the description herein. Alternate embodiments of the present disclosure and their equivalents may be devised without parting from the spirit or scope of the present disclosure. It should be noted that any discussion herein regarding "one embodiment", "an embodiment", "an exemplary embodiment", or a similar phrase indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

While the apparatuses and methods presented herein have been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. For example, the infant positioner or infant support structures/apparatuses presented herein may be modified to contain any number of upstanding frame members, seat supports, interactive assemblies, interactive components, interactive elements, etc. Moreover, the infant positioner or infant support structures/apparatuses presented herein may be modified to resemble any other structure, device, etc.

In addition, various features from one of the embodiments may be incorporated into another of the embodiments. That is, it is believed that the disclosure set forth above may encompass multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Accordingly, it is appropriate that the appended claims be construed broadly and in a manner consistent with the scope of the disclosure as set forth in the following claims.

It is also to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention. Additionally, it is also to be understood that the infant positioner or infant support structures/apparatuses described herein, and any portions thereof, may be fabricated from any suitable material or combination of materials, such as plastic, metals, composites, etc., as well as derivatives thereof, and combinations thereof.

The terms "comprising," "including," "having," and the like, as used with respect to embodiments of the present disclosure, are synonymous. When used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about", "around", "generally", and "substantially."

What is claimed is:

1. An infant positioner, comprising:

a support structure comprising:

a seat support having a first periphery;

at least one support arm;

a tray removably coupleable to the at least one support arm, the tray including a housing with a cavity formed therein, and the tray having a tab that extends into the cavity; and a ground engaging portion engageable with a support surface, the ground engaging portion extending beyond the first periphery of the seat support, the seat support being coupled to the at least one support arm such that the support structure has a deployed configuration, the ground engaging portion has a second periphery, the ground engaging portion includes a base with at least one coupler coupled thereto, the at least one coupler is a flexible strap with at least one tab;

a seat coupled to the seat support, the seat configured to support a child; and an entertainment component removably coupleable to the support structure, the entertainment component being disposable in a first position in which the entertainment component is mounted on the support structure, and in a second position in which the entertainment component is spaced apart from and coupled to the support structure, the entertainment component being proximate to the seat in the first position and proximate to the ground engaging portion in the second position, wherein when the entertainment component is in the second position, at least a portion of the entertainment component is located beyond the second periphery of the ground engaging portion, and wherein the tab engages a slot formed in the entertainment component when the entertainment component is mounted on the tray, and the at least one coupler is engageable with the entertainment component when the entertainment component is in its second position.

2. The infant positioner of claim 1, wherein the cavity receives a portion of the entertainment component when the entertainment component is coupled to the tray.

3. The infant positioner of claim 1, wherein the at least one support arm movably couples the seat support to the ground engaging portion.

4. The infant positioner of claim 1, wherein the entertainment component includes a housing and a pivotally mounted support stand coupled to the housing, the support stand having a first end coupled to the housing and a second end opposite to the first end, the second end is proximate the housing when the entertainment component is in its first position mounted on the support structure, and the second end is spaced apart from the housing when the entertainment component is in its second position spaced apart from and coupled to the support structure.

5. The infant positioner of claim 1, wherein the ground engaging portion includes a base, the at least one support arm is coupled to the seat support and positions the seat support away from the base, the at least one support arm includes a connector, the tray has a connector that is engageable with the at least one support arm connector to mount the tray to the at least one support arm.

6. The infant positioner of claim 1, wherein the at least one support arm is coupled to the seat support and positions the seat support spaced apart from the base.

7. The infant positioner of claim 6, wherein the entertainment component includes a housing with at least one slot formed therein, and the flexible strap is engageable with the at least one slot on the housing to couple the entertainment component to the support structure when the entertainment component is in its second position.

8. The infant positioner of claim 7, wherein the flexible strap includes a first tab and a second tab, the first tab on the flexible strap is usable to retain the entertainment component in its second position, the second tab on the flexible strap is usable to retain the entertainment component in a third position, and the entertainment component in its third position is further spaced apart from the ground engaging portion than when the entertainment component is in its second position.

9. The infant positioner of claim 1, wherein the entertainment component is placeable in a third position in which the entertainment component is spaced apart from and coupled to the support structure, the third position of the entertainment component is farther away from the support structure than the second position of the entertainment component, the support structure includes a coupler that is engageable with the entertainment component, and the support structure is engaged with the entertainment component when the entertainment component is in its second position and in its third position.

10. The infant positioner of claim 9, wherein the coupler is a flexible member with a first positioner and a second positioner coupled thereto, the first positioner engages the entertainment component when the entertainment component is in its second position, and the second positioner engages the entertainment component when the entertainment component is in its third position.

11. An infant positioner, comprising:

a support structure comprising:

a seat support having a periphery; and a ground engaging portion engageable with a support surface, the ground engaging portion extending beyond the periphery of the seat support, the seat support being coupled to the ground engaging portion such that the support structure has a deployed configuration, the ground engaging portion includes a base with a coupler coupled thereto, the coupler is a flexible strap with at least one tab;

a seat coupled to the seat support, the seat configured to support a child; and an entertainment component removably coupleable to the support structure, the entertainment component being disposable in a first position in which the entertainment component is mounted on the support structure, and in a second position in which the entertainment component is spaced apart from and coupled to the support structure, the entertainment component being proximate to the seat in the first position and proximate to the ground engaging portion in the second position, wherein the entertainment component includes a housing with at least one slot formed therein and the flexible strap is engageable with the at least one slot on the housing to couple the entertainment component to the support structure when the entertainment component is in its second position.

12. The infant positioner of claim 11, wherein the flexible strap includes a first tab and a second tab, the first tab on the flexible strap is usable to retain the entertainment component in its second position, the second tab on the flexible strap is usable to retain the entertainment component in a third position, and the entertainment component in its third position is further spaced apart from the ground engaging portion than when the entertainment component is in its second position.

13. The infant positioner of claim 11, wherein the support structure includes a tray that is removably coupleable to the ground engaging portion.

14. The infant positioner of claim 13, wherein the tray has a mounting component that engages the entertainment component when the entertainment component is in its first position.

15. An infant positioner, comprising:

a support structure comprising:

a seat support having a periphery;

a ground engaging portion engageable with a support surface, the ground engaging portion extending beyond the periphery of the seat support, the seat support being coupled to the ground engaging portion such that the support structure has a deployed configuration; and a coupler that is a flexible member with a first positioner and a second positioner coupled thereto;

a seat coupled to the seat support, the seat configured to support a child; and an entertainment component removably coupleable to the support structure, the entertainment component being disposable in a first position in which the entertainment component is mounted on the support structure, and in a second position in which the entertainment component is spaced apart from and coupled to the support structure, the entertainment component being proximate to the seat in the first position and proximate to the ground engaging portion in the second position, wherein the coupler is engageable with the entertainment component, the first positioner engaging the entertainment component when the entertainment component is in its second position, and the second positioner engages the entertainment component when the entertainment component is in a position other than its second position.

16. The infant positioner of claim 15, wherein the entertainment component is placeable in a third position in which the entertainment component is spaced apart from and coupled to the support structure, the third position of the entertainment component is farther away from the support structure than the second position of the entertainment component, and the support structure is engaged with the entertainment component when the entertainment component is in its second position and in its third position.

17. The infant positioner of claim 15, wherein the support structure includes a tray that is removably coupleable to the ground engaging portion, and the tray engages the entertainment component when the entertainment component is in its first position.

* * * * *